United States Patent [19]

Barth et al.

[11] 4,337,598

[45] Jul. 6, 1982

[54] ENDLESS BELT WITH AUTOMATIC STEERING CONTROL

[75] Inventors: Jerry J. Barth, Red Wing; Lawrence A. Martin, White Bear Lake, both of Minn.

[73] Assignee: Minnesota Mining and Manufacturing Company, Saint Paul, Minn.

[21] Appl. No.: 106,272

[22] Filed: Dec. 21, 1979

[51] Int. Cl.[3] ..... B24B 21/18

[52] U.S. Cl. ..... 51/135 BT; 51/394; 198/805

[58] Field of Search ..... 51/135 R, 135 BT, 328, 51/394; 198/807, 805; 226/170, 171, 172; 474/102, 103, 104, 142; 335/205

[56] References Cited

U.S. PATENT DOCUMENTS

| | | | |
|---|---|---|---|
| 1,972,075 | 9/1934 | Clark | 51/135 BT |
| 2,636,692 | 4/1953 | Picking | 242/57.1 |
| 2,655,195 | 10/1953 | Curtis | 198/805 |
| 3,090,488 | 5/1963 | Komune et al. | 74/241 X |
| 3,179,240 | 4/1965 | Kain | 198/805 |
| 3,179,241 | 4/1965 | Kain | 198/805 |
| 3,224,567 | 12/1965 | Kain | 198/805 |
| 3,323,699 | 6/1967 | Bricker | 242/57.1 X |
| 3,570,735 | 3/1971 | Kurz | 242/57.1 X |
| 3,710,369 | 1/1973 | Takahashi | 335/205 X |
| 3,745,717 | 7/1973 | Robinson | 51/135 BT |
| 3,899,071 | 8/1975 | Duffy | 198/805 X |
| 3,971,166 | 7/1976 | Habeck et al. | 51/135 BT |
| 4,061,222 | 12/1977 | Rushing | 474/103 X |

*Primary Examiner*—Stephen G. Kunin
*Assistant Examiner*—Robert P. Olszewski
*Attorney, Agent, or Firm*—Cruzan Alexander; Donald M. Sell; William B. Barte

[57] ABSTRACT

Automatic tracking of an endless belt, such as a coated abrasive belt, is provided by fitting the belt with at least one permanent magnet, preferably of a flexible, rubber bonded sheet-like variety such as is conveniently adhered to the backside of the belt. One or more magnetic sensors positioned transversely to a longitudinal line defined by the path of the magnets as the belt is driven between rollers detect the magnets in the event the belt exceeds an allowed extent of transverse movement, in which event a control signal is generated which activates a steering mechanism causing the belt to move in the opposite transverse direction.

14 Claims, 5 Drawing Figures

ENDLESS BELT WITH AUTOMATIC STEERING CONTROL

FIELD OF THE INVENTION

This invention relates to endless belts, to apparatus in which such belts are employed, and to features combining both the belt and the apparatus whereby the belt is automatically steered or tracked or caused to repeatedly traverse between allowed limits of transverse motion normal to an edge of the belt.

In particular, the invention is primarily directed to coated abrasive belts including a backing having a layer of abrasive material thereon and to grinding machines employing such belts and in which means are provided for automatically steering or tracking the belt.

DESCRIPTION OF THE PRIOR ART

Numerous techniques have heretofore been proposed and at least implemented to some degree for automatically steering or tracking endless belts. Endless belts are commonly employed in a wide variety of applications, such as in the form of filter webs, conveyor belts, drive belts, and abrasive belts, in which mechanical limit switches, photoelectric cells, pneumatic and capacitive sensors are used to monitor transverse movement of the respective webs or belts in order to activate appropriate mechanisms to counteract or otherwise control the transverse movement.

For example, U.S. Pat. No. 3,323,699 (Briker) depicts a system for controlling the path of a web of electrically conductive material, such as a steel roll, in which the material forms one plate of a capacitor, the other plate being a conductive tab positioned proximate one edge of the web. Changes in the lateral position of the web thus change the capacitance between the web and the tab, which change is used as a control signal. While other sensors, including photoelectric cells, edge-contacting devices, infrared sensors, hydraulic sensors, and other similar hydraulic and/or electrical variations are proposed, they are noted to have inherent problems when subjected to adverse environmental factors, such as dust, heat, humidity, and vibration.

U.S. Pat. No. 3,570,735 (Kurz) is also directed to a web guiding system which, while preferring to use photoelectric cells to detect lateral deviations at the edge of the web, suggests that pneumatic and mechanical, as well as many other types of sensors, may be used.

U.S. Pat. No. 3,090,488 (Komline et al) is particularly noteworthy with respect to the present invention, in that it suggests the placement of visual indicia or reference points or elements on an endless filter belt designed for movement at a quite low rate of speed, which reference elements are adapted to be sensed by appropriately positioned sensors to generate a position control signal. Komline et al suggests that the reference elements may consist of small sections of magnetic material and that the sensing elements be conventional magnetic pickups.

SUMMARY OF THE INVENTION

In contrast to the systems described in the patents discussed hereinabove, which are generally directed to particular steering control features based on any variety of sensing devices or, as in the case of Komline et al, to a system in which a special reference element is added to the belt but in which the belt is intended only for operation at quite low rates of speed, the present invention is directed to a particular type belt, namely an endless coated abrasive belt, provided with a unique reference element enabling control over the transverse position of the belt when operated in a grinding machine at high surface velocities such as those ranging between approximately 500–10,000 surface feet per minute. Particularly, the abrasive belt of the present invention comprises a backing having on one side thereof a coating of abrasive granules and has as a part thereof a permanent magnet movable with the belt. The magnet is positiond such that the poles thereof exhibit a given orientation with respect to an edge of the belt to enable detection of movement of the belt in either direction transverse to its length to thus enable control over the transverse position. In a preferred embodiment, a thin tab of a flexible magnet construction, having poles perpendicular to the surface of the tab, is adhered to the backside of the belt.

A grinding machine using the coated abrasive belt of the present invention includes a plurality of spaced and aligned supporting rollers, one of which is movably mounted to control the transverse position of the belt with respect to a path around the rollers, drive means for moving the position-controlling roller, together with means for sensing movement of the belt transverse to its length and for providing a transverse movement signal indicative of the direction of transverse motion to the drive means to cause movement of the position-controlling roller such as to impart transverse movement of the belt in a direction opposite to the sensed direction. While the present invention is particularly directed to the control of endless abrasive belts such as are commonly employed in diverse types of commercial grinding applications, the present invention is similarly directed to other types of webs, such as filters and the like.

In grinding operations using endless abrasive belts it is often desirable to provide a wear path on the belt which is wider than the work piece being abraded. Accordingly, with the system of the present invention, the transverse path of the belt can be controlled not only to maintain a given tracking position, but also to force the belt to move transversely between limits defined by the placement of the magnet sections, thereby providing the desired extended wear path.

The sensing means included in the grinding machine comprises the combination of the magnet provided with the belt, magnetic field sensing means positioned adjacent the path of the magnet for responding to a change in the field provided by the magnet as a result of transverse movement of the belt and for providing the transverse movement signal indicative of the direction of movement, and means responsive to the transverse movement signal for controllably energizing the drive means to impart a reverse transverse movement to the belt.

The system of the present invention has been found to be desirable particularly when used in environments where large quantities of particulate matter are present, which particulates may be prone to interfere especially with optical sensors such have been utilized heretofore, by totally blocking the desired light signal to its respective sensor. In high speed grinding operations where large quantities of swarf or other abraded material are generated, the magnetic sensors of the present invention have been found to be especially advantageous in that the magnetic signal typically is not interrupted or appreciably attenuated by the presence of such material.

DESCRIPTION OF THE PREFERRED EMBODIMENTS

Figure 1:
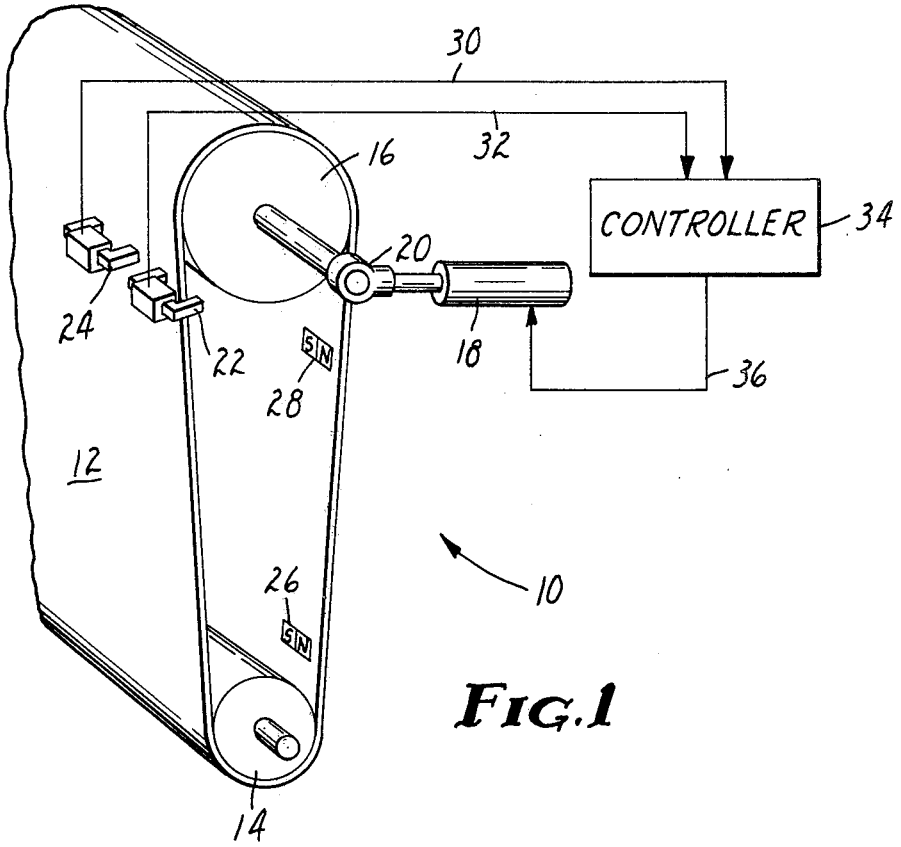
FIG. 1 is a combined pictorial and block diagram of one embodiment of the present invention.

As shown in FIG. 1, one embodiment of the present invention includes an apparatus 10 for driving an endless belt 12 around a pair of rollers 14 and 16, respectively, including continuously controlling the transverse tracking of the belt. Preferably, one of the rollers 14 is selected as the contact wheel having a fixed angular alignment and is used as a belt support against which a work face would be applied. Movement of the belt 12 is provided by driving one of the rollers 14 or 16 by suitable driving means (not shown). In order to control transverse movement of the belt on the rollers 14 and 16, such that the tranverse position of the belt is maintained within predetermined limits, the angular alignment of the axis of one other roller 16 is desirably varied with respect to that of the roller 14. As shown in FIG. 1, control over such alignment is provided by a mechanism which includes an air cylinder 18 coupled by a linking member 20 to the shaft of the roller 16.

The controlled tracking feature of the present invention is further shown in FIG. 1 to include a pair of magnetic sensors 22 and 24 which are positioned transversely across the path of the belt 12. The belt 12 is further provided with at least one section of a permanent magnet material 26. If desired, at least one additional section, such as section 28, may be provided about the length of the belt, all such sections mounted on the belt so as to be positioned a constant distance from one edge of the belt, i.e. along a line parallel to the primary direction of travel of the belt. As shown in FIG. 1, the sections of magnetic material 26 and 28 are positioned so that when the belt is in its center tracking position, the sections of magnetic material are equally spaced between the magnetic sensors 22 and 24. As the belt moves transversely, the magnetic sections are sensed by one or the other of the magnetic sensors 22 or 24, and will thereupon provide a signal on one of the respective leads 30 or 32. Signals on those leads are coupled to controller 34, which in the manner described hereinafter, provides control signals on leads 36 to drive the air cylinder 18 in the appropriate direction to cause the belt to move away from the sensor which resulted in the production of the control signal.

Figure 2:
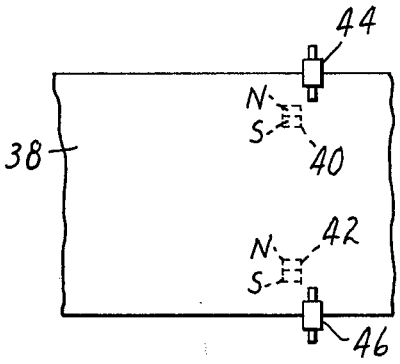
FIG. 2 is a top view of an abrasive belt and sensor combination pursuant to another embodiment of the present invention.

Depending upon the requirements of the given application, a variety of alternatives are available as to the placement of the permanent magnets relative to the abrasive belt, as well as the placement of the magnetic sensors which respond to such magnets. For example, as shown in FIG. 2, the system may utilize an endless belt 38, upon which are secured a pair of permanent magnets 40 and 42, which magnets are secured proximate opposite edges of the belt. In such an embodiment, each of the magnetic sensors 44 and 46 is positioned outside of the longitudinal path of a corresponding magnetic section 40 or 42 such that when the belt moves in either transverse direction, one of the respective magnet sections intercepts its respective sensor and thus provides a track controlling signal.

Figure 3:
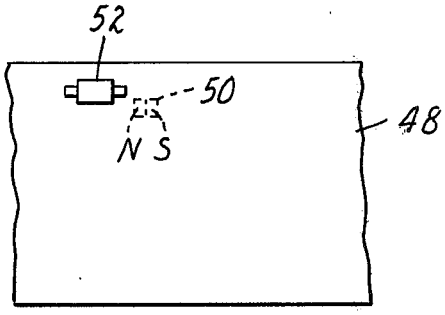
FIG. 3 is a top view of an abrasive belt and sensor combination pursuant to yet another embodiment.

In a further embodiment as shown in FIG. 3, it is also recognized that the system may be provided with but one magnetic sensor and a single section of magnet. As is there shown, an abrasive belt 48 is provided with a section of permanent magnet 50 positioned proximate one edge of the belt, and a single sensor 52 is positioned along the normal running track of the belt, outside of the normal location of the magnet 50. In such an embodiment, the apparatus used to drive the belt provides a mechanical bias which continually forces the abrasive belt transversely toward the side at which the magnetic sensor is provided. The magnetic sensor in turn provides a counter driving signal which causes the belt to move transversely in the direction opposite that provided by the mechanical bias. Accordingly, when the force causing transverse movement due to the electrical control signal is equal to the force provided by the mechanical bias, a steady state condition is reached, at which the belt remains in a controlled path.

Figure 4:
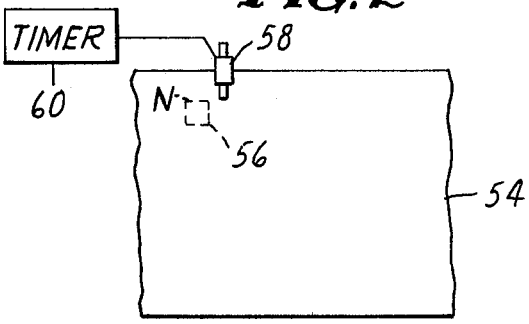
FIG. 4 is a combined top view and block diagram of a different embodiment.

In a further embodiment shown in FIG. 4, the use of a mechanical bias may be modified by use of a timing circuit. In such an embodiment, an abrasive belt 54 is provided with a section of magnet 56, mounted on the belt proximate to one edge thereof, and a single magnetic sensor 58 is mounted along the path of the belt and outside the normal tracking position of the magnet. When used with a timer, the mechanical bias causes the belt to continually move toward the edge at which the magnetic sensor 58 is provided. When the sensor 58 detects the magnet 56, a timer 60 may be activated, which causes a mechanical driving motion such as provided by the air cylinder 18 in FIG. 1 to be energized for a predetermined length of time, thus causing the belt to move in an opposite direction at a controlled rate for that period of time. At the expiration of that time, the countering movement is terminated and the belt again drifts in the direction toward the magnetic sensor 58.

It may be seen that a variety of configurations may be constructed, all of which are within the scope of the present invention and in which the magnetic configuration may be varied, depending upon the dictates of the given installation. For example, in FIGS. 1–4, the orientation of the magnetic polarities in the magnets, as well as the relative positioning of the magnet sections themselves on the belts, has been varied. Preferably, the magnet material is a flexible rubber-bonded permanent magnet material such as "Plastiform" Brand rubber bonded magnets, manufactured by Minnesota Mining and Manufacturing Company. Such magnet materials are desirably provided in sheets of varying thickness and may be cut in a convenient fashion by a razor blade or whatever, to the desired size. Further, such a magnetic material may be magnetically polarized in a variety of fashions, such as to provide a single pole along one surface of the sheet and an opposite pole along the entire opposite surface of the sheet. Alternatively, the material may be alternately magnetized so as to have a progression of north-south poles along one surface of the sheet, and an opposite succession of poles on the opposite surface of the sheet. Such an alternating polarity is shown as elements 26 and 28 of FIG. 1. Regardless of what orientation of magnet material is selected, the magnetic sensors utilized proximate the path of the abrasive belt may then be selected according to a manner well known to those skilled in the art to optimize the detection.

Rubber bonded magnet constructions as described above are further desirably provided in that they may be conveniently affixed to the abrasive belt by means of a suitable flexible adhesive. For example, sheets of such material may be bonded to the underside of an abrasive belt using conventional quick set adhesives, phenolic or epoxy resins, or the like. The flexibility and thinness of such constructions enables the material to be utilized on the abrasive belts and used in conventional grinding apparatus without adverse effects due to the presence of the magnetic material.

For example, test utilizing the configurations set forth hereinabove, "Plastiform" Brand rubber bonded magnets having thicknesses of 0.004 inches, 0.008 inch and 0.015 inch have been found to provide readily sensible signals, even when the magnetic sensors were positioned as far away from the surface of the belt as ⅜ inch.

Depending upon the sensitivity of the detector and the proximity to the belt that can be tolerated in a given installation, the permanent magnet material may also be provided in the form of one or more layers of high energy magnetic recording tape, or coatings of a magnetic material applied directly to the backside of the abrasive belt and thereafter magnetized as desired. For example, slurries of either barium ferrite or of particles more typically utilized in magnetic recording tape constructions may be coated onto the backside of the abrasive belts and thereafter dried to provide the desired sections of permanent magnets.

While a variety of magnetic sensors, such as are well known to those skilled in the art, may be utilized in the present invention, a particularly desirable sensor has been found to be readily constructed from a 2.5 KΩ coil, such as is utilized in a conventional electromagnetic relay. Such a coil is then desirably fitted with a core and pole pieces, which pole pieces are spaced approximately ⅜th of an inch apart. Such a sensor is desirably utilized together with an abrasive belt having two sections of magnetic material adhered to it, side by side, approximately ⅛" apart, each section having a uniform magnetic pole on each surface and so arranged that one section has a first polarity facing one pole piece sensor, while the second section has the opposite polarity facing the other pole piece. In such a configuration, a signal of nearly 1/10th of a volt was detected for "Plastiform" Brand materials as thin as 0.004 inch thick when the sensor was positioned ⅜th of an inch above the surface of the belt. Obviously, for magnet thicknesses greater than that mentioned and for sensors positioned closer to the abrasive surface, signals of appreciably higher magnitude are detectable.

Figure 5:
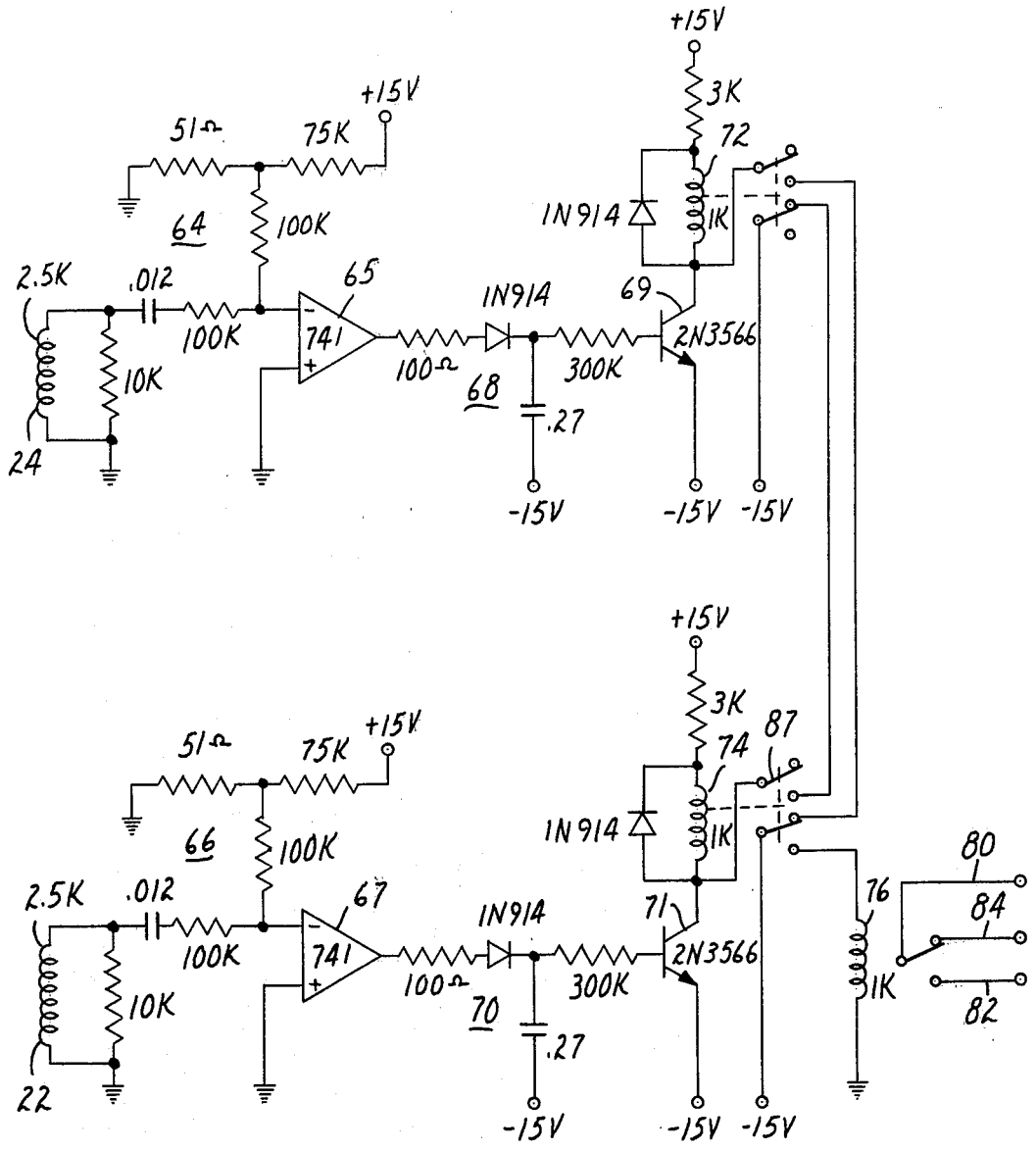
FIG. 5 is a schematic diagram of a preferred circuit for use in the embodiments of FIGS. 1 and 2.

The manner by which the signals provided by the sensors 22 and 24 such as shown in FIG. 1 may be utilized to control an air cylinder 18 so as to accurately steer an endless belt is shown in the circuit of FIG. 5. As may there be seen, a preferred circuit consists of two identical comparator circuits, each of which activates a relay when its respective input coil or pickup generates a voltage due to the magnet passing by it. The contacts of each relay are connected in a flip-flop arrangement so that only one of them can be activated at a given time. This bi-stable action is then connected to an output relay which activates solenoid valves that in turn control the air flow to the air cylinder 18 as shown in FIG. 1. By connecting the appropriate input to the desired channel of the comparator circuit, it may thus be seen that the belt may be caused to be steered toward the sensor associated with the unactivated channel, thus causing the belt to oscillate between the two pickup coils.

Each of the comparator circuits shown in FIG. 5 are of relatively conventional construction and include a voltage divider and impedence matching network shown generally as 64 and 66, respectively, to which the pickup coils 22 and 24 are coupled. The output from these networks are then coupled to the negative inputs of integrated circuit operational amplifiers 65 and 67, respectively, such as types 741, the positive imputs of which are grounded. The outputs of the operational amplifiers are in turn coupled through RC networks, shown generally as 68 and 70, respectively, and thence to switching transistors 69 and 71, respectively, such as Types 2N3566. The collector of each of the transistors is in turn coupled through a voltage dropping resistor and a 1 k/ohm coil of relays 72 and 74, respectively. As mentioned above, the contacts for the relays 72 and 74 are interconnected in a flip-flop type arrangement such that when one of the relays is activated, power is automatically removed from the opposite relay.

It may thus be seen that when pickup 22 is proximate a magnet such that an input current is induced in the pickup, a voltage is developed within the voltage divider network 66 which causes the operational amplifier 67 to change its state. This in turn provides an output to the RC network 70, thereby providing a triggering signal which causes the transistor 71 to conduct, thereby causing relay 74 to close. This in turn closes one set of contacts of the relay so as to energize the output relay 76, thereby switching a potential on lead 80 to lead 82, which is appropriately coupled to air valves so as to cause the air cylinder 18 to drive the belt toward pickup 24. At the same time the second set of contacts 87 of relay 74 are also closed, thereby applying a negative voltage coupled through one set of contacts of relay 72 to one side of the coil of relay 74, thus causing the relay to remain energized after transistor 71 switches off.

When a signal is thereafter detected by the other pickup 24 in a manner identical to that set forth hereinabove, such pickup will ultimately result in transistor 69 switching into a conducting state. When that occurs relay 72 closes, and by so doing a first set of contacts of that relay opens, causing power to be withdrawn from relay 74, causing that relay to open. The opening of the relay 74, in turn allows power to be applied to one side of the coil of relay 72, thus causing that relay to remain closed. The opening of relay 74 similarly removes power from relay 76, such that a potential on lead 80 is then applied to lead 84, causing appropriate air valves to be closed such that the air cylinder 18 is caused to drive the belt in the opposite direction. Accordingly, the belt 12 is caused to oscillate between the two sensors 22 and 24.

While the operation of the present invention is described in terms of the specific circuit shown in FIG. 5, it is with in the scope of the present invention that a variety of similar control circuits may be utilized either with a single sensor mounted adjacent one side of the belt, or with a variety of dual sensors, such as have been discussed hereinabove.

Having thus described the present invention, what is claimed is:

1. In a grinding machine utilizing an endless coated abrasive belt, a plurality of spaced and aligned rollers for supporting said belt, one of said rollers being movably supported to control the transverse position of the belt with respect to a path about the rollers, drive means for moving said position controlling roller, and sensing means for sensing movement of the belt transverse to its length and for providing a transverse movement signal indicative of the direction of transverse motion to the drive means to cause movement of said position controlling roller such as to impart transverse movement of the belt in a direction opposite to the sensed direction, wherein said sensing means comprises:

at least one permanent magnet comprising a flexible magnet material including domain sized particles supported by a polymeric binder, said magnet being a part of the belt, movable with the belt, and being positioned such that the poles thereof exhibit a given orientation with respect to an edge of the belt, magnetic field sensing means positioned adjacent the path of the magnet on the belt for responding to a change in the field provided by a said magnet as a result of transverse movement of the belt and for providing said transverse movement signal indicative of the direction of said transverse movement, and means responsive to said transverse movement signal for controllably energizing said drive means to impart a reverse transverse movement to said belt.

2. A grinding machine according to claim 1 wherein said sensing means includes a pair of sensors spaced apart a distance defining an allowed extent of transverse excursion and wherein a single magnet is provided on said belt, said sensors being positioned on both sides of said magnet such that a signal is induced in either of the sensors upon movement of the magnet adjacent that sensor.

3. A grinding machine according to claim 1 wherein said sensing means includes a pair of sensors and said belt includes a pair of magnets, the allowable extent of transverse exclusion of said belt being defined by the difference between the separation between the pair of sensors and the separation between the pair of magnets.

4. An endless coated abrasive belt comprising a backing having on one side thereof a layer of abrasive granules, said belt having as a part thereof at least one discrete permanent magnet affixed adjacent at least one edge of the belt and movable therewith, said magnet extending over short lengths thereof such that the longitudinal dimension of the belt is substantially free of said magnet, and comprising a flexible magnet material including domain sized particles supported by a polymeric binder and being positioned such that the poles thereof exhibit a given orientation with respect to an edge of the belt to enable detection of movement of the belt in either direction transverse to its length to enable control over the transverse position of the belt.

5. An abrasive belt according to claim 4 wherein said material is shaped as a thin strip having a thickness not greater than 0.03 inch (0.8 mm) and a width not greater than 0.5 inch (12 mm).

6. An abrasive belt according to claim 4, comprising a flexible magnet adhered to backside of the backing.

7. An abrasive belt according to claim 4 wherein the poles of said magnet are aligned transverse to one edge of the belt.

8. An abrasive belt according to claim 4 wherein the poles of said magnet are aligned parallel to one edge of the belt.

9. An abrasive belt according to claim 4 wherein the poles of said magnet are aligned perpendicular to the surface of the belt.

10. An abrasive belt according to claim 4 further comprising as a part thereof at least a second permanent magnet movable with the belt, each of said magnets being positioned adjacent an opposite edge of the belt.

11. An abrasive belt according to claim 10 wherein the poles of both of said magnets are oriented normal to the surface of the belt.

12. An abrasive belt according to claim 11 wherein the poles of both of said magnets exhibit a like polarity.

13. An abrasive belt according to claim 11 wherein the polarity of the poles of the first magnet is opposite that of the second magnet.

14. A method of controlling the transverse position of an endless belt during movement thereof between a drive and support roller respectively, comprising the steps of (a) providing said endless belt with at least one permanent magnet comprising a flexible magnet material including domain sized particles supported by a polymeric binder, and positioning said magnet on said belt such that the magnetic poles exhibit a given orientation with respect to an edge of the belt;

(b) detecting a change in the magnetic field provided by a said magnet as a result of transverse movement of the belt and providing a transverse movement signal indicative of the direction of said transverse movement, and (c) responding to said transverse motion signal to controllably energize at least one of said rollers to alter the axial alignment thereof, thereby controlling the transverse position of the belt.

* * * * *